US005202015A

United States Patent [19]

Harandi

[11] Patent Number: 5,202,015

[45] Date of Patent: Apr. 13, 1993

[54] PROCESS FOR DISTILLATE DEWAXING COINCIDENT WITH LIGHT OLEFIN OLIGOMERIZATION

[75] Inventor: Mohsen N. Harandi, Lawrenceville, N.J.

[73] Assignee: Mobil Oil Corporation, Fairfax, Va.

[21] Appl. No.: 644,144

[22] Filed: Jan. 22, 1991

[51] Int. Cl.[5] ..... C10G 11/04; C10G 11/05

[52] U.S. Cl. ..... 208/119; 208/120; 208/135; 585/330; 585/533; 585/693; 585/739

[58] Field of Search ..... 208/119, 120, 135; 585/330, 533, 653, 739

[56] References Cited

U.S. PATENT DOCUMENTS

| | | | |
|---|---|---|---|
| 3,891,540 | 6/1975 | Demmel et al. . | |
| 3,960,978 | 6/1976 | Givens et al. . | |
| 4,289,607 | 9/1981 | Kokotailo | 208/120 |
| 4,419,220 | 12/1983 | LaPierre et al. . | |
| 4,541,919 | 9/1985 | LaPierre et al. . | |
| 4,597,854 | 7/1986 | Penick . | |
| 4,788,366 | 11/1988 | Harandi . | |
| 5,000,840 | 3/1991 | Anthes et al. | 208/111 |
| 5,009,851 | 4/1991 | Avidan et al. | 208/71 |
| 5,053,579 | 10/1991 | Beech, Jr. et al. | 208/71 |

*Primary Examiner*—David Brunsman
*Attorney, Agent, or Firm*—Alexander J. McKillop; Charles J. Speciale; L. G. Wise

[57] ABSTRACT

Process conditions and process configuration have been discovered for the concurrent but independent catalytic reaction of waxy distillate and light olefins feedstocks that simultaneously results in the dewaxing of distillate feedstock and the oligomerization of light olefins to produce olefinic gasoline. In the novel process, under the conditions discovered, the opposing reactions of molecular weight reduction, as exemplified by waxy n-paraffin cracking, and molecular weight growth, as exemplified by olefin oligomerization, have been found to compatibly coexist to achieve the sought after objective of producing olefinic gasoline while dewaxing distillate in a single conversion step. Partial desulfurization and denitrogenation of the distillate feed also occurs. It has also been discovered that the novel process can be conveniently integrated with hydrocarbon catalytic cracking operations in a manner which advantageously utilizes the unsaturated gas plant and main fractionator of the cracking process to facilitate the separation of the products of the novel conversion process.

20 Claims, 2 Drawing Sheets

PROCESS FOR DISTILLATE DEWAXING COINCIDENT WITH LIGHT OLEFIN OLIGOMERIZATION

This invention relates to a process for the production of $C_5+$ gasoline and low pour point distillate. The process involves the concurrent catalytic oligomerization of light olefins plus cracking and/or isomerization of lightly branched or normal paraffins in a waxy distillate to produce gasoline and low pour point distillate. More particularly, the invention involves the advantageous integration of the novel process for simultaneous olefin oligomerization and distillate dewaxing into catalytic hydrocarbon cracking processes to permit the common utilization of product separation operations.

BACKGROUND OF THE INVENTION

Processes for dewaxing petroleum distillates have been known for a long time. Dewaxing is, as is well known, required when highly paraffinic oils are to be used in products which need to remain mobile at low temperatures e.g., lubricating oils, heating oils, jet fuels. The higher molecular weight straight chain normal and slightly branched paraffins which are present in oils of this kind are waxes which are the cause of high pour points in the oils and if adequately low pour points are to be obtained, these waxes must be wholly or partly removed. Catalytic dewaxing processes are employed to selectively crack the longer chain n-paraffins to produce lower molecular weight products which may be removed by distillation. Processes of this kind are described in The Oil and Gas Journal, Jan. 6, 1974, pages 69–73 and U.S. Pat. No. 3,668,113.

In order to obtain the desired selectivity, the catalyst is usually a zeolite having a pore size which admits the straight chain n-paraffins or slightly branched paraffins but which excludes more highly branched material, cycloaliphatics and aromatics. Zeolites such as ZSM-5, ZSM-11, ZSM-12, ZSM-23, and ZSM-35 have been proposed for this purpose. Medium pore zeolites have the preferred property of selectivity and their use forms the basis of the Mobil Distillate Dewaxing process (MDDW). MDDW is a fixed bed process that typically operates at 20 to 55 atm (2058 kPa to 5660 kPa), 260°–430° C. reactor temperature, and 40–70 $m^3/b$ of hydrogen circulation.

U.S. Pat. No. 4,332,670 to Antal discloses catalytic dewaxing of FCC light oil with ZSM-5 employing hydrogen recycle. U. S. Pat. No. 4,483,760 to Tabak describes sequential fixed bed dewaxing of middle distillate with flash separation. U. S. Pat. No. 4,419,220 to Lapiere et al. discloses fluidized bed dewaxing-isomerization of distillate fuel oil over zeolite beta. U.S. Pat. No. 4,541,919, also to Lapiere et al., discloses fluidized bed hydrodewaxing with ZSM-5. U.S. Pat. No. 3,891,540 to Demmel et al. discloses a combined process for catalytic cracking and distillate dewaxing using ZSM-5 catalyst. U.S. Pat. Nos. 4,181,598 to Gilespie et al 4,283,271 and 4,283,272 to Garwood et also describe the Mobil Lube and Distillate Dewaxing Process (MLDW) using zeolite catalyst. The foregoing patents, of common assignee, are incorporated herein by reference in their entirety.

Conversion of olefins to gasoline and/or distillate product is disclosed in U.S. Pat. Nos. 3,960,978 and 4,021,502 (Givens,Plank and Rosinski) wherein gaseous olefins in the range of ethylene to pentene, either alone or in admixture with paraffins, are converted into a gasoline blending stock by contacting the olefins with a catalyst bed made up of ZSM-5 or related zeolite. In U.S. Pat. Nos. 4,150,062 and 4,227,992 Garwood et al discloses the operating conditions for the Mobil Olefin to Gasoline/Distillate (MOGD) process for selective conversion of $C_3+$ olefins. A fluidized bed process for converting ethene-containing light olefinic streams, sometimes referred to as the Mobil Olefin to Gasoline (MOG) process is described by Avidan et al in U.S. patent application 006,407, filed 23 Jan. 1987. The phenomena of shape-selective polymerization are discussed by Garwood in ACS Symposium Series No. 218, Intrazeolite Chemistry, "Conversion of $C_2$–$C_{10}$ to Higher Olefins over Synthetic Zeolite ZSM-5", 1983 American Chemical Society.

In the process for catalytic conversion of olefins to heavier hydrocarbons by catalytic oligomerization using an acid crystalline metallosilicate zeolite, such as ZSM-5 or related shape selective catalyst, process conditions can be varied to favor the formation of either gasoline or distillate range products. In the gasoline operating mode ethylene and the other lower olefins are catalytically oligomerized at elevated temperature and moderate pressure. Under these conditions ethylene conversion rate is greatly increased and lower olefin oligomerization is nearly complete to produce a gasoline blending stock in good yield.

The olefins contained in an FCC gas plant are an advantageous feed for oligomerization. U.S. Pat. No. 4,090,949 discloses upgrading olefinic gasoline by conversion in the presence of carbon hydrogen-contributing fragments including olefins and a zeolite catalyst and where the contributing olefins may be obtained from a gas plant. U.S. Pat. Nos. 4,471,147 and 4,504,691 disclose an oligomerization process using an olefinic feedstock derived from FCC effluent. In these two latter patents the first step involves prefractionating the olefinic feedstock to obtain a gaseous stream rich in ethylene and a liquid stream containing $C_3+$ olefin.

The conventional MOG process design is concerned with converting ethylene in a fuel gas stream, such as an FCC offgas, to gasoline. Motor octane of the gasoline produced is generally about 80–85. Typically, paraffins conversion under MOG process conditions is not significant.

It is an object of the present invention to provide a process for the simultaneous dewaxing of distillate fuel oil and the oligomerization of light olefins to $C_5+$ gasoline.

Another object of the invention is to provide the foregoing process employing zeolite catalyst in a common conversion zone.

Yet another object of the invention is to integrate the foregoing process invention with catalytic or thermal cracking operations in order to utilize light olefin products and unsaturated gas plant separation vessels.

SUMMARY OF THE INVENTION

The process conditions and process configuration have been discovered for the concurrent but independent catalytic reaction of waxy distillate and light olefins feedstocks that simultaneously results in the dewaxing of distillate feedstock and the oligomerization of light olefins to produce olefinic gasoline. In the novel process, under the conditions discovered, the opposing reactions of molecular weight reduction, as exemplified by waxy n-paraffin cracking, and molecular weight growth, as exemplified by olefin oligomerization, have been found to compatibly coexist to achieve the sought after objective of producing gasoline while dewaxing distillate in a single conversion step. It has also been discovered that the novel process can be conveniently integrated with hydrocarbon catalytic cracking operations in a manner which advantageously utilizes the unsaturated gas plant of the cracking process and/or the cracker main column to facilitate the separation of the products of the novel conversion process.

More particularly, a process has been discovered for the production of $C_5$+ gasoline and dewaxed distillate, comprising: contacting a hydrocarbon feedstream comprising light olefin and high pour point distillate rich in waxy n-paraffins with a fluidized bed of acidic shape selective metallosilicate catalyst particles under reaction conditions sufficient to concurrently oligomerize said light olefins while cracking said n-paraffins, whereby an effluent vapor is produced containing products comprising $C_5$+ gasoline and dewaxed distillate having a low pour point. In addition, the aromatics content of distillate will dealkylate and redistribute producing more gases.

The invention further comprises an integrated process for the production and separation of $C_5$+ gasoline and dewaxed distillate products, comprising:

catalytically or thermally cracking a hydrocarbon feedstock to provide a crackate comprising $C_1$–$C_4$ hydrocarbons containing light olefins, $C_5$+ gasoline, and distillate rich in waxy n-paraffins;

fractionating the crackate and passing at least a portion of the light olefins plus the distillate containing n-paraffins to a fluidized bed reaction zone containing acidic shape selective metallosilicate catalyst particles under reaction conditions sufficient to concurrently oligomerize said light olefins while cracking and/or isomerizing said distillate n-paraffins, whereby an effluent vapor is produced containing products comprising said $C_5$+ gasoline and dewaxed distillate having a low pour point.

At least the non-condensible portion of the foregoing effluent is preferably passed to an absorber in contact with lean oil from the catalytic cracking process main fractionator and recovering rich oil containing the products. The rich oil is recycled to the maim fractionator along with the condensible portion of said effluent for separating and recovering the products.

DETAIL DESCRIPTION OF THE INVENTION

Figure 1:
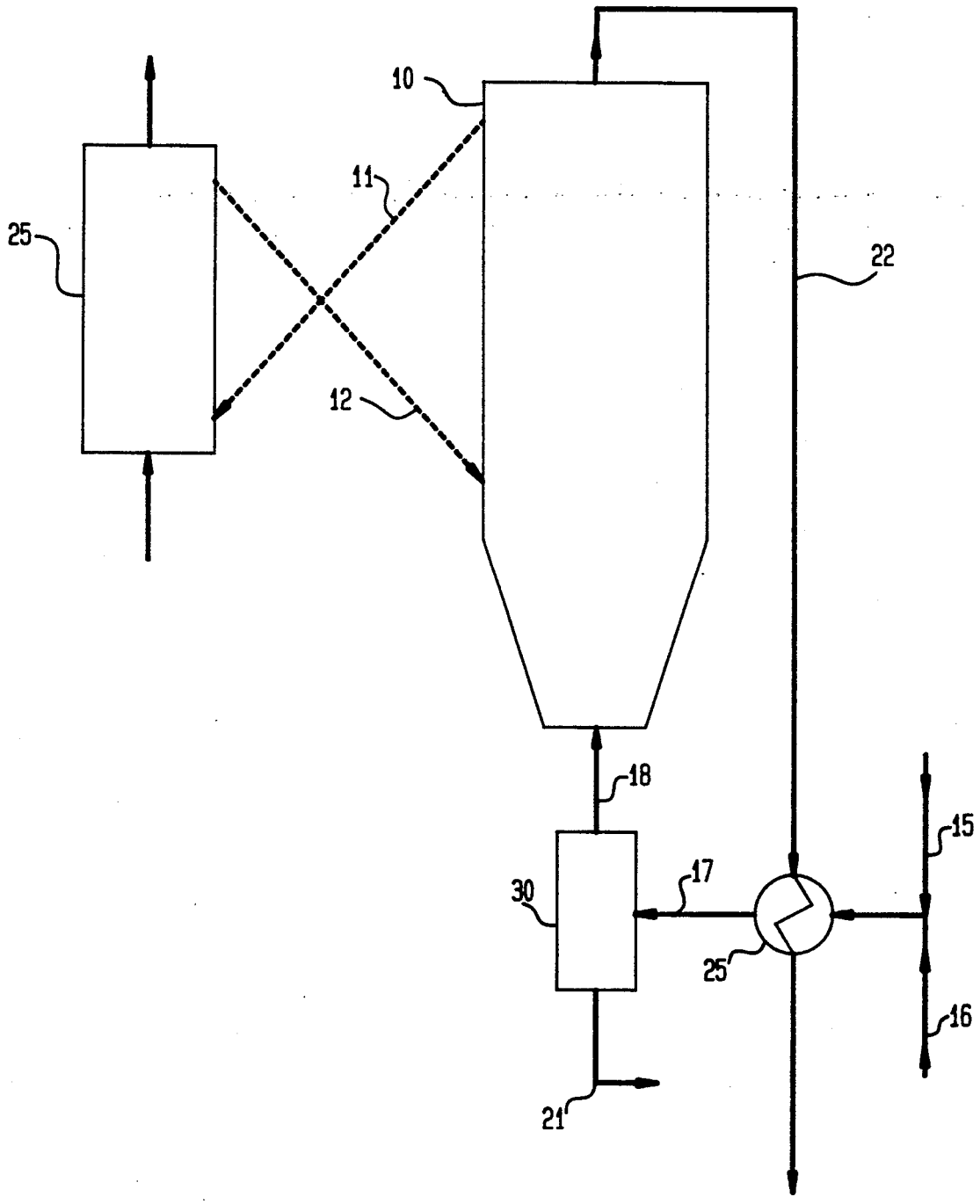
FIG. 1 is a schematic diagram of the present invention illustrating the combination of olefin upgrading and distillate dewaxing in a single reactor.

In one embodiment of the present invention the Mobil Olefins to Gasoline process (MOG) is combined with distillate dewaxing to produce high light olefin conversion as part of a unique fluid bed process for high octane gasoline production, concomitant with the production of dewaxed, low pour point distillate. The MOG process is well-known in the petroleum refining arts and provides a system for upgrading light olefins, such as FCC product components, to liquid hydrocarbons, utilizing a continuous process for producing fuel products by oligomerizing olefinic components to produce higher hydrocarbon products for use as fuel or the like. The preferred MOG feedstock contains $C_2$–$C_4$ alkenes (mono-olefin) in the range of about 10 to 90 wt %. Non-deleterious components, such as methane and other paraffins and inert gases, may be present. A particularly useful feedstock is a light gas by-product of FCC gas oil cracking units containing typically 10–40 mol % $C_2$–$C_4$ olefins and 5–35 mol % $H_2$ with varying amounts of $C_1$–$C_3$ paraffins and inert gas, such as $N_2$. The process may be tolerant of a wide range of lower alkanes, from 0 to 90%. Preferred feedstocks contain more than 50 wt % $C_1 1 \propto C_4$ lower aliphatic hydrocarbons, and contain sufficient olefins to provide total olefinic partial pressure of at least 50 kPa.

Light olefins as employed herein particularly comprise ethene, propene, 1-butene, 2-butene and isobutene. Conversion of lower or light olefins, especially ethene, propene and butenes, over HZSM-5 in the MOG process is effective at moderately elevated temperatures and pressures. Operating details for typical olefin oligomerization units are disclosed in U.S. Pat. Nos. 4,456,779; 4,497,968 (Owen et al.) and 4,433,185 (Tabak), incorporated herein by reference. In the present invention FCC fuel gas is the preferred light olefin containing feed, but $C_3$ or $C_4$ hydrocarbon feedstreams containing propene may be utilized. A typical fuel gas feed to the process of the invention contains about 13 mole % ethene, 8 mole % propene, with the balance including methane, L ethane, propane and $C_4$'s, plus about 10 mole % hydrogen.

Catalysts useful in the MOG process and the process of the instant invention include a unique group of metallosilicate zeolites. Recent developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, or Fe, within the zeolytic framework. These medium pore zeolites are favored for acid catalysis; however, the advantages of ZSM-5 structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

The oligomerization catalyst preferred for use in olefins conversion and the process of the present invention includes the medium pore (i.e., about 5–7 angstroms) shape selective crystalline aluminosilicate zeolites having a silica to alumina ratio of about 20:1 or greater, a constraint index of about 1–12, and acid cracking activity (alpha value) of about 1–200, preferably an alpha value between 1 and 10, but more preferably an alpha of about 4. "Alpha value", or "alpha number", is a measure of zeolite acidic functionality and is more fully described together with details of its measurement in U.S. Pat. No. 4,016,218, *J. Catalysis*, 6, pp. 278–287 (1966) and *J. Catalysis*, 61, pp. 390–396 (1980).

Representative of the shape selective zeolites are ZSM-5, ZSM-11, ZSM-12, ZSM-22, ZSM-23, ZSM-35, ZSM-48, zeolite Beta and MCM-22. ZSM-5 is disclosed in U.S. Pat. No. 3,702,886 and U.S. Pat. No. Reissue 29,948. Other suitable zeolites are disclosed in U.S. Patent Nos. 3,709,979 (ZSM-11); 3,832,449 (ZSM-12); 4,076979; 4,076842 (ZSM-23); 4,016,245 (ZSM-35); and 4,375,573 (ZSM-48). M C M - 2 2 i s described in U.S. Pat. No. 4,954,325 to M. K. Rubin and P. Chu, issued Sep. 4, 1990. It has a $SiO^2/Al_2O_3$ ratio of 10 to 150, usually 20 to 40, with a high Alpha value, usually above 150. Zeolite Beta is described in U.S. Reissue Pat. No. 28,341, of original U.S. Pat. No. 3,308,069). The disclosures of these catalyst related patens are incorporated herein by reference.

The term distillate or distillate feedstock as used herein refers to those hydrocarbon products commercially utilized as fuel oil, diesel fuel, tractor oil and the like, following dewaxing. They typically have an initial boiling point between about 160° C. and 250° C., up to about 375° C. at their 90 percent ASTM distillation level. Light distillate boils between about 176 C. and 343° C. while heavy distillate boils above about 342° C. Prior to dewaxing they have a pour point within the range of about −25° C. to +5° C. The waxy distillate can be dewaxed employing the MDDW process under conditions as described herein before, to produce dewaxed distillate with a pour point below −5° C., preferably below −15° C.

The co-processing of waxy distillate and light olefins in a fluidized bed of zeolite catalyst, preferably ZSM-5, is carried out in the novel process of this invention under low pressure i.e., greater than 140 kPa but preferably between about 200 kPa and 1500 kPa. The reactor operates at a temperature between about 342 and 482° C., but preferably about 399° C. The weight hourly space velocity (WHSV) is greater than 0.1 based on light olefins or waxy distillate feed. The combined feedstock is preheated to a temperature between about 260° C. and 415° C.

In a preferred embodiment the process is carried out at a pressure of about 840 kPa and reactor temperature of about 399° C. employing a fluidized bed of ZSM-5 catalyst particles having an alpha value of about 4. Under these conditions the waxy feed is typically a liquid. However, due to the presence of light olefinic feed all the distillate can be vaporized. Based on olefins in the feed the WHSV is about 0.5; weight ratio of the feedstock fuel gas to waxy distillate is about 2.0. The combined feedstock is preheated to temperature of about 370° C. Under these conditions, a thermally balanced conversion reaction is carried out wherein the oligomerization exotherm produced from olefin oligomerization is partially balanced by the endotherm of n-paraffin cracking reactions provided in the waxy distillate feedstock. The additional heat available from the oligomerization reaction is used to vaporize the waxy feed and preheat the feedsteams. The result is an energy efficient process producing $C_5$+ gasoline and dewaxed distillate. Notably, this result is achieved without adding to the process any more hydrogen than may coincidentally occur in the feedstock; a factor in shape contrast to prior art dewaxing processes.

Referring to FIG. 1, a diagram of the present invention is depicted illustrating the combination of olefin upgrading and distillate dewaxing in a single reaction section. The reactor 10 contains a fluidized bed of preferably ZSM-5 catalyst particles connected through conduits 11 and 12 to a catalyst regenerator vessel 20 for oxidative or hydrogenative regeneration of spent catalyst and recirculation of reactivated catalyst to reactor 20. Regeneration preferably is accomplished at about the same pressure as the reactor and at about 426° C.–593° C., but preferably about 510° C. A fuel gas feedstream 15 and a waxy distillate feedstream 16 is passed to reactor 10 through conduits 17 and 18, preferably after preheating and heat exchange 25 with product stream 22. Heat exchanger 25 may be disposed internally in the fluid bed reactor 10 to maintain a reactor feed preheat to achieve a desirable reactor effluent temperature. This configuration is particularly preferred since it results in a maximization of feed preheat which allows a higher potential for vaporizing all the distillate feed prior to entering the fluid bed reactor. A knock-out pot 30 is optionally included to remove any unvaporized feed through conduit 21. The reaction products comprising $C_5$+ gasoline and dewaxed distillate are removed, preferably overhead, from the reactor and separated downstream by absorption and/or distillation means not shown. Applying the aforestated preferred operating conditions to the process configuration of FIG. 1 results in the uniquely advantageous utilization of a single vessel or single reactor system to produce both gasoline by olefin oligomerization and dewaxed distillate by paraffin cracking.

Figure 2:
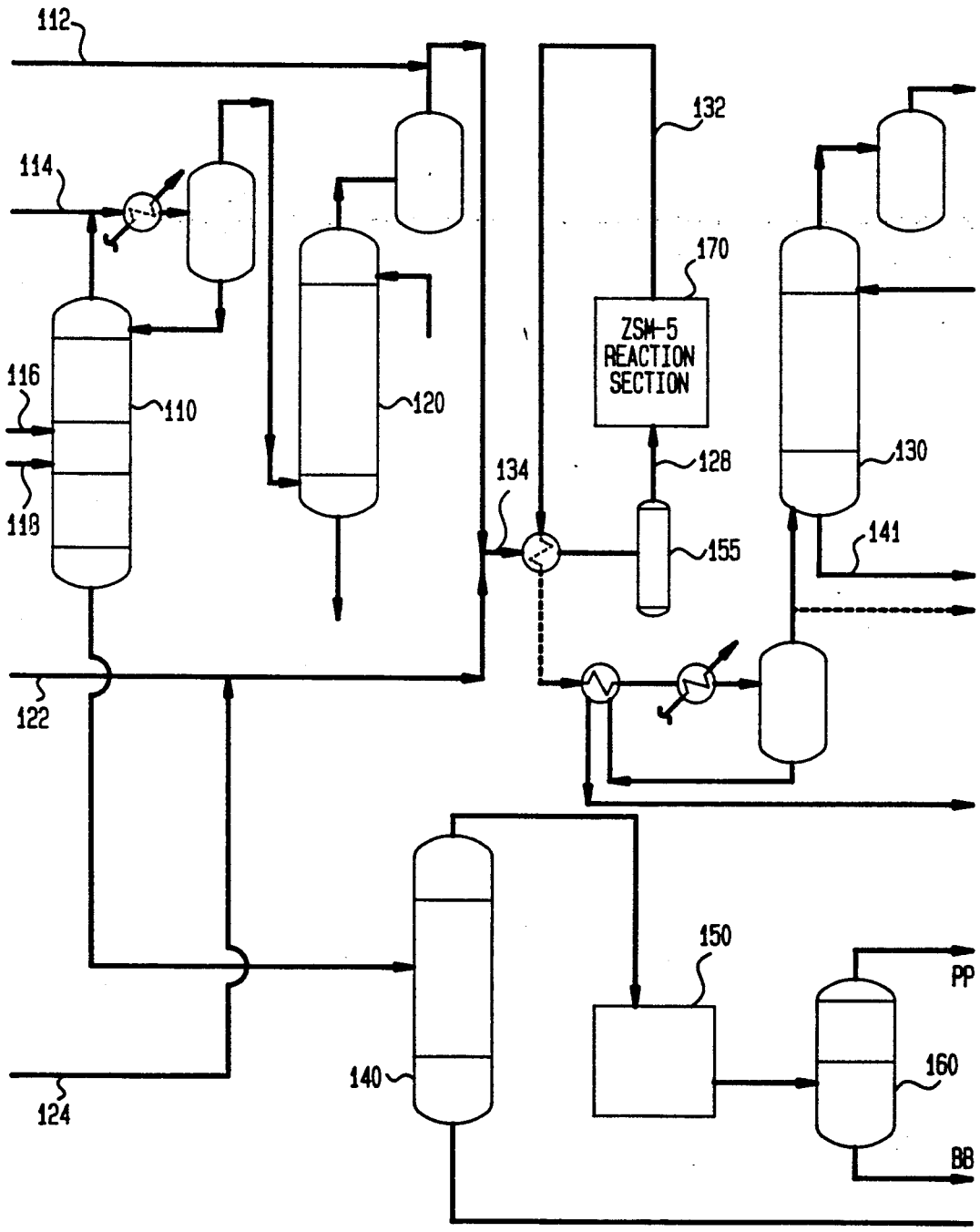
FIG. 2 is a schematic diagram of the invention illustrating a mode of integration with the unsaturated gas plant of a fluid catalytic cracking (FCC) process.

Referring now to FIG. 2, another embodiment of the present invention is presented illustrating a mode of integration with the unsaturated gas plant (USGP) of a fluid catalytic cracking (FCC) process. The USGP contains the conventional separation vessels known in the art, i.e., deethanizer 110, amine absorber 120, sponge absorber 130, debutanizer 140, Merox unit and depropanizer 160. Integrated into the reactor system is the fluidized bed reactor section 170 for olefins oligomerization and distillate dewaxing under conditions described above. The feedstreams to the system include waxy distillate 112, unstabilized gasoline 114, gas and liquid deethanizer feeds 116 and 118, propane/propene stream 122, and benzene rich feed 124. The PP stream 122, light hydrocarbons from deethanizer 110, optional benzene rich feed 124, and distillate 112 comprise the feedstock to reactor 170 introduced through conduit 128, following liquids removal in K.0. pot 155. Reaction products 132 are employed to preheat 145 the reaction feedstream 134. The reaction products are further separated in sponge absorber 130 wherein the rich oil containing products of the oligomerization and dewaxing reactions can be passed to the main FCC fractionator for separation and recovery.

When the option is exercised to include a benzene feedstream 124 to the process, alkylation of the benzene with light olefins will be realized in the process. In addition, olefin containing gasoline streams such as FCC $C_5$–$C_9$ hydrocarbon streams can also be fed to the reactor to improve product quality and/or partially upgrade it to distillate.

A particular advantage of the distillate dewaxing carried out according to the process of this invention is that the dewaxed distillate is partially desulfurized and denitrogenized in the course of the process. Accordingly, not only is the distillate product of the invention improved with respect to a lower pour point but the capability to simultaneously meet sulfur and nitrogen product specification is enhanced, without requiring separation desulfurization or denitrogenization steps.

While the invention has been described by reference to specific embodiments, there is no intent to limit the scope of the invention except as described in the following claims.

What is claimed is:

1. A process for the production of $C_5$+ gasoline and dewaxed distillate, comprising:

contacting hydrocarbon feedstreams comprising light olefin and distillate containing waxy n-paraffins with a fluidized bed of medium pore acidic shape selective metallosilicate catalyst particles of 5–7 angstroms pore size, said catalyst particles having an acid cracking activity or alpha value between about 1 to 10, under reaction conditions comprising pressure between 140 kPa and 1500 kPa, temperature between about 342° C. and 482° C. and weight hourly space velocity greater than 0.1 sufficient to concurrently oligomerize said light olefins while cracking said n-paraffins, whereby an effluent vapor is produced containing products comprising said $C_5$+ gasoline and dewaxed distillate having a low pour point.

2. The process of claim 1 wherein said process is carried out in the substantial absence of added hydrogen.

3. The process of claim 1 wherein said light olefin comprises $C_2$–$C_4$ olefin.

4. The process of claim 1 wherein said light olefin comprises propene.

5. The process of claim 1 wherein said light olefin and said distillate containing waxy n-paraffins comprise a portion of the product stream from a catalytic or thermal cracking process.

6. The process of claim 1 wherein said conditions further include feed preheat temperature between about 260° C. and 415° C.

7. The process of claim 1 wherein said reaction conditions comprise pressure of about 840 kPa, temperature of about 399° C., weight hourly space velocity of about 0.5 based on olefins in the feed' weight ratio of light olefin to distillate of about 0.1, and feed preheat temperature of about 371° C.

8. The process of claim 1 wherein said conditions comprise contacting said feedstreams at a rate sufficient to thermally balance said light olefin oligomerization exotherm with said n-paraffin vaporizing and cracking endotherm.

9. The process of claim 1 wherein said alpha value is about 4.

10. The process of claim 1 wherein said catalyst comprises ZSM-5 .

11. The process of claim 1 wherein said distillate containing waxy n-paraffins comprises high nitrogen and/or sulfur content distillate and said dewaxed distillate includes partially desulfurized and/or denitrogenized dewaxed distillate.

12. The process of claim 1 wherein said hydrocarbon feedstreams include benzene and said reaction conditions are sufficient to concurrently oligomerize said light olefins while cracking said n-paraffins and alkylating said benzene, whereby an effluent vapor is produced containing products comprising said $C_5$+ gasoline containing alkyl aromatics and dewaxed distillate having a low pour point.

13. A process for the production of $C_5$+ gasoline and dewaxed distillate, comprising:

contacting hydrocarbon feedstreams comprising light olefin and distillate containing waxy n-paraffins with a fluidized bed of medium pore acidic shape selective metallosilicate catalyst particles, said catalyst particles having an acid cracking activity or alpha value between about 1 and 10, under reaction conditions comprising pressure between 140 kPa and 1500 kPa, temperature between about 342° C. and 482° C. and weight hourly space velocity greater than 0.1 sufficient to concurrently oligomerize said light olefins while cracking said n-paraffins, whereby an effluent vapor is produced containing products comprising said $C_5$+ gasoline and dewaxed distillate having a low pour point;

passing said effluent to an absorber in contact with lean oil from a catalytic cracking process main fractionator; recovering rich oil containing said products; recycling said rich oil to said fractionator; and separating and recovering sad products.

14. An integrated process for the production and separation of $C_5$+ gasoline and dewaxed distillate products, comprising:

catalytically or thermally cracking a hydrocarbon feedstock to provide a crackate comprising $C_1$–$C_4$ light hydrocarbons containing olefins, $C_5$+ gasoline, and distillate rich in aromatics and containing sulfur and waxy n-paraffins;

fractionating said crackate and passing a portion of said light hydrocarbons containing olefins plus said distillate to a fluidized bed reaction zone containing medium pore acidic shape selective metallosilicate catalyst particles, said catalyst particles having an acid cracking activity or alpha value between about 1 and 10, under reaction conditions comprising pressure between 140 kPa and 1500 kPa, temperature between about 342° C. and 482° and weight hourly space velocity greater than 0.1 sufficient to concurrently oligomerize said olefins while desulfurizing, dealkylating and cracking said distillate, whereby an effluent vapor is produced containing products comprising $C_5$+ gasoline and dewaxed distillate having a lower amount of sulfur;

passing said effluent to an absorber in contact with lean oil from said cracking process main fractionator and recovering rich oil containing said products;

recycling said rich oil to said main fractionator;

and separating and recovering said products.

15. The process of claim 14 wherein said light hydrocarbons containing olefins plus said distillate are passed to said fluidized ed reaction zone in conjunction with benzene feedstream under reaction conditions sufficient to concurrently oligomerize said light olefins while desulfurizing, dealkylating and cracking said distillate and alkylating said benzene, whereby an effluent vapor is produced containing products comprising said $C_5$+ gasoline containing alkylaromatics and dewaxed distillate having a low pour point.

16. The process of claim 14 wherein sad conditions further include feed preheat temperature between about 260° C. and 415° C.

17. The process of claim 14 wherein said reaction conditions comprise pressure of about 840 kPa, temperature of about 399° C., weight hourly space velocity of about 0.5 based on olefins in the feed' weight ratio of light olefin to distillate of about 0.1, and feed preheat temperature of about 371° C.

18. The process of claim 14 wherein said conditions comprise contacting said feedstreams at a rate sufficient to thermally balance said light olefin oligomerization exotherm with said n-paraffin cracking endotherm.

19. The process of claim 18 wherein said alpha value is about 4.

20. The process of claim 15 wherein said catalyst comprises ZSM-5.

* * * * *